US007591391B2

(12) United States Patent
Nielsen

(10) Patent No.: US 7,591,391 B2
(45) Date of Patent: Sep. 22, 2009

(54) DRINKING VESSEL TRAY

(76) Inventor: Peter Nielsen, 7327 McKinley Rd., Kansas City, MO (US) 64158

( * ) Notice: Subject to any disclaimer, the term of this patent is extended or adjusted under 35 U.S.C. 154(b) by 429 days.

(21) Appl. No.: 11/295,871

(22) Filed: Dec. 7, 2005

(65) Prior Publication Data

US 2006/0123829 A1 Jun. 15, 2006

Related U.S. Application Data

(60) Provisional application No. 60/634,765, filed on Dec. 9, 2004.

(51) Int. Cl.
*B65D 1/24* (2006.01)

(52) U.S. Cl. ..... 220/556; 62/384; 62/386; 62/457.5; 141/144; 141/145; 141/146; 141/147

(58) Field of Classification Search ..... 62/384, 62/457.3, 457.4, 457.5, 457.6, 457.9, 368, 62/388, 389, 386; 206/519, 562; 312/351; 220/23.2; 222/442; 141/144–147
See application file for complete search history.

(56) References Cited

U.S. PATENT DOCUMENTS

| | | | | | |
|---|---|---|---|---|---|
| 1,538,483 | A | * | 5/1925 | Grantham | 141/352 |
| 1,996,300 | A | * | 4/1935 | Lindsay | 294/143 |
| 2,313,954 | A | * | 3/1943 | Mariani | 62/125 |
| 3,353,717 | A | * | 11/1967 | Edwards | 222/132 |
| 4,582,230 | A | * | 4/1986 | Vierkotter | 222/442 |
| D285,638 | S | * | 9/1986 | Trivison | D7/557 |
| 4,803,604 | A | * | 2/1989 | Nichols et al. | 362/154 |
| 4,874,083 | A | * | 10/1989 | Antoni et al. | 220/523 |
| 4,889,148 | A | * | 12/1989 | Smazik | 137/1 |
| 4,967,648 | A | * | 11/1990 | Helbling | 99/280 |
| 4,991,713 | A | * | 2/1991 | Phillips | 206/218 |
| 5,186,367 | A | * | 2/1993 | Hickerson | 222/207 |
| 5,207,743 | A | * | 5/1993 | Costarella et al. | 220/574 |
| 5,390,798 | A | * | 2/1995 | Yanuzzi | 206/562 |
| 5,513,496 | A | * | 5/1996 | Stokes | 62/3.64 |
| 5,711,595 | A | * | 1/1998 | Gerbe | 362/84 |
| 5,769,264 | A | * | 6/1998 | Lipkowitz | 220/575 |
| D404,612 | S | * | 1/1999 | Blazevich | D7/505 |
| 5,954,195 | A | * | 9/1999 | Krueger et al. | 206/217 |
| 5,971,139 | A | * | 10/1999 | Bradley | 206/217 |
| 6,131,732 | A | * | 10/2000 | Schneider | 206/217 |
| 6,264,026 | B1 | * | 7/2001 | Bradley | 206/217 |
| 2002/0027366 | A1 | * | 3/2002 | Bieri | 294/159 |
| 2005/0011908 | A1 | * | 1/2005 | Danby | 222/1 |
| 2005/0034604 | A1 | * | 2/2005 | Halliday et al. | 99/279 |

* cited by examiner

*Primary Examiner*—Frantz F Jules
*Assistant Examiner*—Azim Rahim
(74) *Attorney, Agent, or Firm*—Robert J. Yarbrough

(57) ABSTRACT

The Invention is a tray for serving a beverage in a nightclub or tavern. A tray body defines a reservoir adapted to contain a beverage. A reservoir aperture communicates through the tray body and is controlled by a valve. A dispensing opening is defined by the bottom side of the tray body and aligns the drinking vessel with the reservoir aperture. The valve is actuated when a drinking vessel is placed in engagement with the dispensing opening. A plurality of drinking vessel receptacles located on the top side of the tray are adapted to support drinking vessels.

17 Claims, 7 Drawing Sheets

DRINKING VESSEL TRAY

RELATED APPLICATIONS

This utility application is related to and claims priority from provisional patent application No. 60/634,765 filed Dec. 9, 2004.

BACKGROUND OF THE INVENTION

1. Field of the Invention

The Invention is a tray for use in serving beverages, particularly alcoholic beverages, in a tavern, nightclub or casino. The Invention has particular application for serving beverages using the Dry Ice Drinking Vessel of U.S. patent application Ser. Nos. 10/957,983 and 10/645,019 both by Nielsen, which applications are hereby incorporated by reference as if set forth in full herein, application Ser. No. 10,645,019 is now issued as U.S. Pat. No. 6,868,694 to Nielsen, which is incorporated by reference as if set forth in full herein.

2. Description of the Prior Art

For purposes of this application, any facility that serves alcoholic beverages by the drink is referred to as a "nightclub." A server in a nightclub may use a tray to carry a plurality of individual servings of alcoholic beverages. For example, the server may place shot glasses on a tray, fill the shot glasses from a beverage bottle, and then carry the tray with the filled shot glasses to patrons.

U.S. patent application Ser. Nos. 10/957,983 and 10/645,019 (and issued U.S. Pat. No. 6,868,694) teach a tray having lights directed through the shot glasses to illuminate the shot glasses and the beverages in the glasses. Those applications and patent also teach a Dry Ice Drinking Vessel in which dry ice may be segregated within a drinking vessel while allowing the beverage to contact the dry ice. As used in this application, the term "Dry Ice Drinking Vessel" means drinking vessels for use with dry ice as taught by U.S. patent application Ser. Nos. 10/957,983 and 10/645,019 and by issued U.S. Pat. No. 6,868,694. The sublimation of the dry ice by heat from the beverage causes a boiling, smoking visual effect. Lighting of the drinking vessel by the tray enhances the visual effect, making the beverage more appealing to a patron of the nightclub.

SUMMARY OF THE INVENTION

The Invention is a tray for use in serving beverages. A tray body has a top side and a bottom side. The top side defines a covered reservoir for holding a beverage. A channel communicates from the reservoir through the tray top. A metered valve controls the flow of the beverage through the channel.

The bottom side defines a drinking vessel-receiving opening, which aligns a drinking vessel with the metered valve. The drinking vessel-receiving opening and metered valve are configured so that a server may place an empty drinking vessel under the tray within the dispensing opening and actuate the valve with the drinking vessel. The metered valve will allowed a predetermined amount of the beverage to flow from the reservoir through the reservoir aperture into the drinking vessel and to then automatically terminate the flow of the beverage. The server removes the drinking vessel from the drinking vessel-receiving opening and either places the filled drinking vessel on the tray or serves the beverage to a customer.

Drinking vessel receptacles appear on the periphery of the tray. Lamps, preferably light emitting diodes (LEDs), are positioned so that an upward-shining LED appears under each drinking vessel receptacle, illuminating each drinking vessel from below. Additional LEDs are positioned to illuminate the reservoir and the beverage contained within the reservoir. A switch and power supply, such as a battery, are contained within the tray and selectively power the LEDs.

The Invention may be used in two different manners, either alone or in combination. In the first method of use of the tray, the server will place empty drinking vessels around the periphery of the tray. The server will add a predetermined amount, such as a liter, of an alcoholic beverage to the central reservoir. The server then will add dry ice to the central reservoir and will cover the reservoir with a removable, loose-fitting lid. The dry ice will begin sublimating as it absorbs heat from the beverage in the reservoir. The sublimating dry ice will make the beverage in the reservoir appear to boil as the bubbles of carbon dioxide are released from the dry ice, creating a visual effect. The sublimated carbon dioxide gas will escape from the reservoir and flow past the lid to the ambient air. The sublimated carbon dioxide gas will form a continuously moving and changing cloud of water vapor over and around the tray, creating a second visual effect. The LED lights will illuminate the boiling beverage and the cloud of water vapor, enhancing the visual effect, particularly in a dimly lit nightclub. The visual effects render the beverage more attractive to a patron of the nightclub.

The tray may be configured to take advantage of either or both of these visual effects, as by selecting substantially translucent or transparent materials from which to construct all or part of the tray, thereby highlighting the boiling visual effect, or selecting opaque materials from which to construct all or part of the tray thereby obscuring the visual effect.

In the second method of using the Invention, the server places Dry Ice Drinking Vessels in the drinking vessel receptacles along the periphery of the tray. The Dry Ice Drinking vessels do not contain a beverage, but are charged with dry ice as taught by U.S. patent application Ser. Nos. 10/957,983 and 10/645,019 and by U.S. Pat. No. 6,868,694. The server then places the predetermined amount of the beverage in the reservoir and covers the reservoir with the removable, loose-fitting lid. The server serves the beverage to a patron by removing one of the Dry Ice Drinking Vessels from the receptacle, placing the Dry Ice Drinking Vessel within the dispensing opening and activating the metered valve. A predetermined amount of the beverage will flow from the reservoir past the metered valve and through the reservoir aperture and into the Dry Ice Drinking Vessel. The server then removes the Dry Ice Drinking Vessel from the dispensing opening. The beverage in the Dry Ice Drinking Vessel is exposed to the dry ice segregated within the Dry Ice Drinking Vessel. The dry ice in the Dry Ice Drinking Vessel sublimates releasing carbon dioxide gas. The release of the carbon dioxide gas causes the beverage in the Dry Ice Drinking Vessel to appear to boil, resulting in a visual effect. The release of carbon dioxide gas causes a cloud of water vapor to form over and around the Dry Ice Drinking Vessel, resulting in a second visual effect. The visual effects make the beverage more attractive to a patron of the nightclub.

DESCRIPTION OF AN EMBODIMENT

Figure 1:
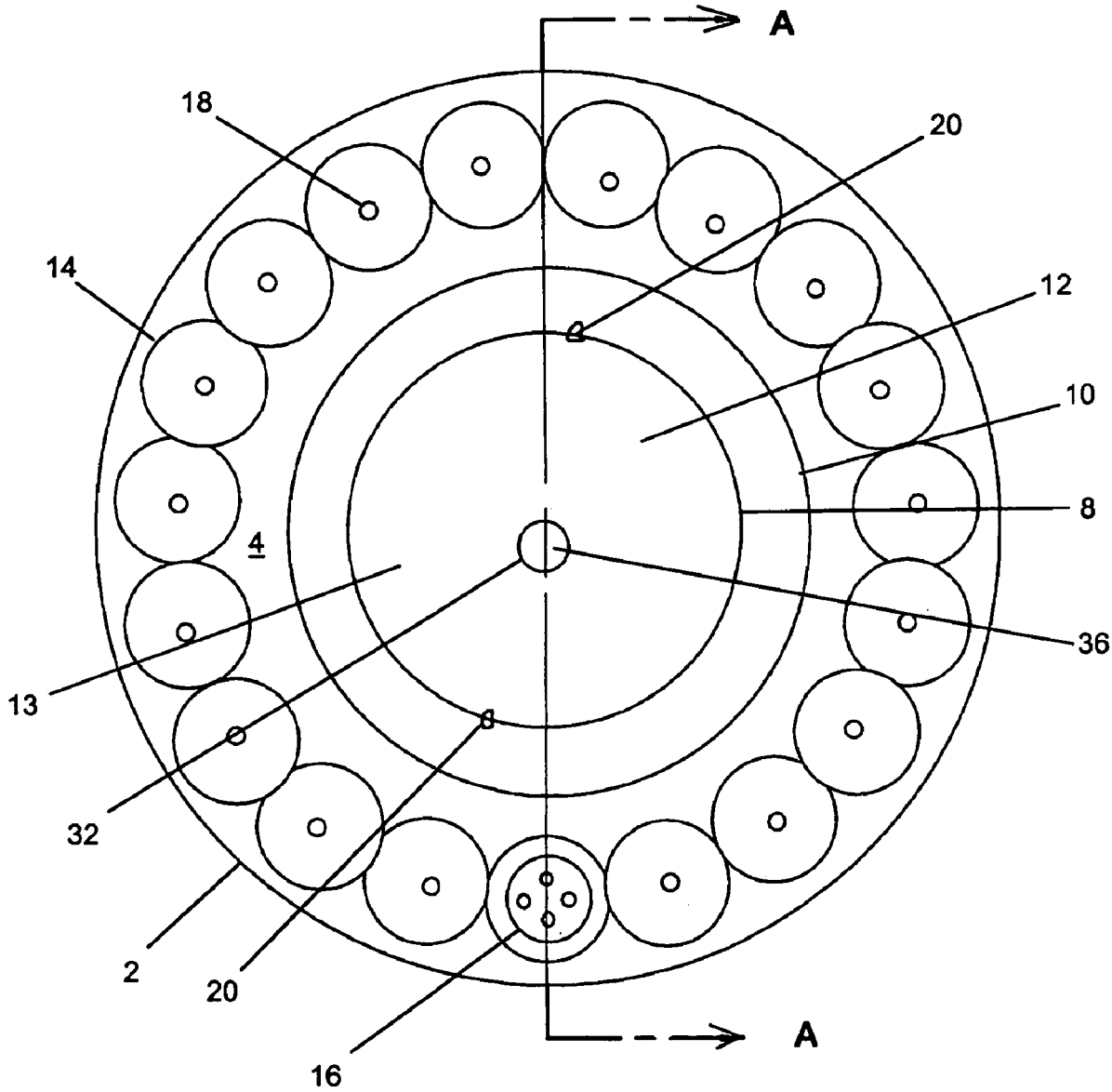
FIG. 1 is a top view of the Invention.
Figure 2:
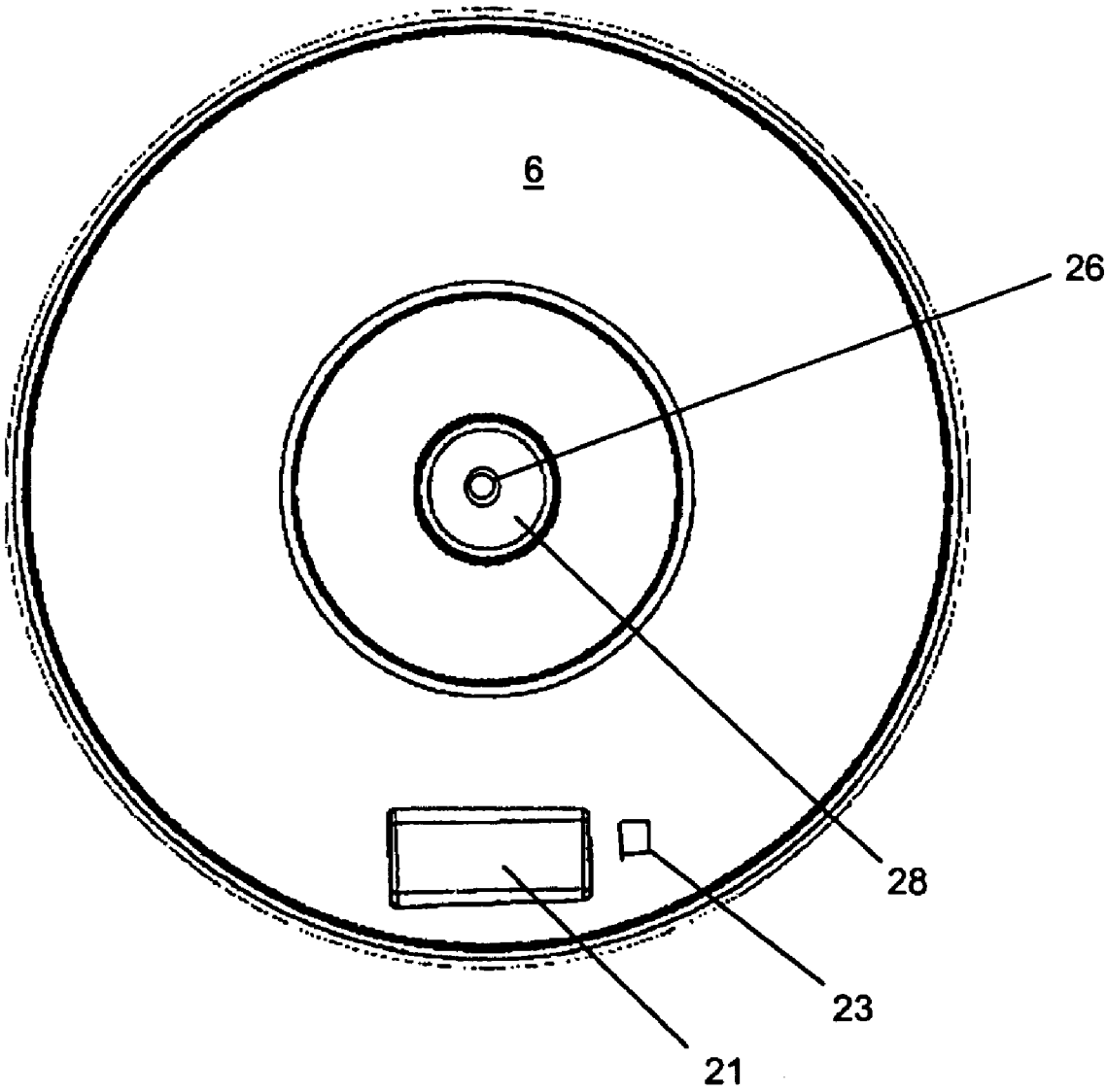
FIG. 2 is a bottom view of the Invention.

As shown by FIGS. 1 and 2, the Invention is a tray for serving beverages in a nightclub. FIG. 1 is a view of the top side 4 of the tray body 2. FIG. 2 is a view of the bottom side 6 of tray body 2. Tray body 2 is composed of an upper portion 3 and a lower portion 5. Upper portion 3 and lower portion 5 are joined one to the other to form tray body 2. Upper portion 3 and lower portion 5 are separately formed of vacuum-formed plastic. Upper portion 3 and lower portion 5 are connected one to the other by any convenient means, such as by hook-and-loop fasteners. A common brand name for such hook-and-loop fasteners is Velcro™.

As shown by FIG. 1, an inner wall 8 and an outer wall 10 of upper portion 3 define a reservoir 12. The reservoir 12 has an interior volume 13 and is configured to contain a predetermined amount, such as one liter, of a beverage 15.

Upper portion 3 of tray body 2 also defines drinking vessel receptacles 14. Drinking vessel receptacles 14 are molded into upper portion 3 and each receptacle 14 is configured to receive and to support a drinking vessel 16. In the embodiment illustrated by FIG. 1, drinking vessel 16 is a Dry Ice Drinking Vessel. In the embodiment illustrated by FIG. 1, upper portion 3 defines nineteen drinking vessel receptacles 14. Each drinking vessel receptacle 14 includes a drinking glass lamp 18, preferably an LED, arranged to direct light upward from the top side 4 of tray body 2 through drinking vessel 16, illuminating drinking vessel 16 and any beverage contained within drinking vessel 16.

Upper portion 3 of tray 2 may include reservoir lamps 20, preferably LEDs, mounted to direct light into reservoir 12, illuminating any beverage 15 contained within reservoir 12. FIG. 2 shows battery box 21 molded into lower portion 5 of tray body 2. The battery box 21 contains one or more batteries, which provide the electrical power to operate the LEDs 18, 20. A switch 23 allows the server to selectively illuminate the LEDs. The electrical connections between LEDs 18, 20, battery box 21 and switch 23 are conventional.

Figure 3:
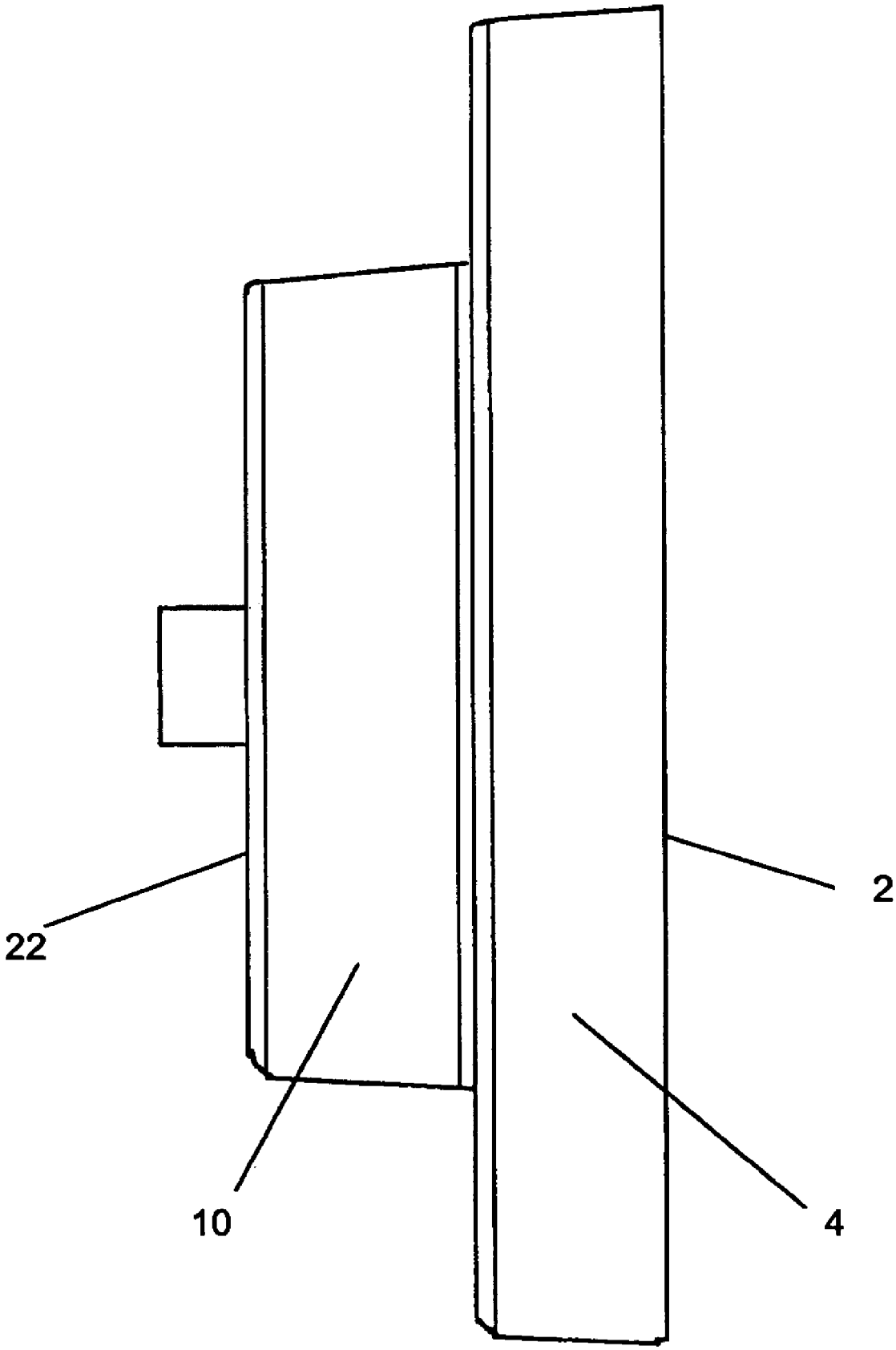
FIG. 3 is a side view of the Invention

FIG. 3 shows a side view of the tray body 2. Shown by FIG. 3 is the upper portion 3 and outer wall 10 defined by upper portion 3. Also shown by FIG. 3 is a removable lid 22. Removable lid 22 is adequately tight to prevent substantial beverage 15 from spilling from reservoir 12 during normal handling of the tray body 2 by the server, but is adequately loose to allow sublimated carbon dioxide gas to flow past the removable lid 22 into the ambient air when dry ice is placed within the reservoir 12. Alternatively, removable lid 22 may be perforated to allow sublimated carbon dioxide to escape from the reservoir 12.

Figure 4:
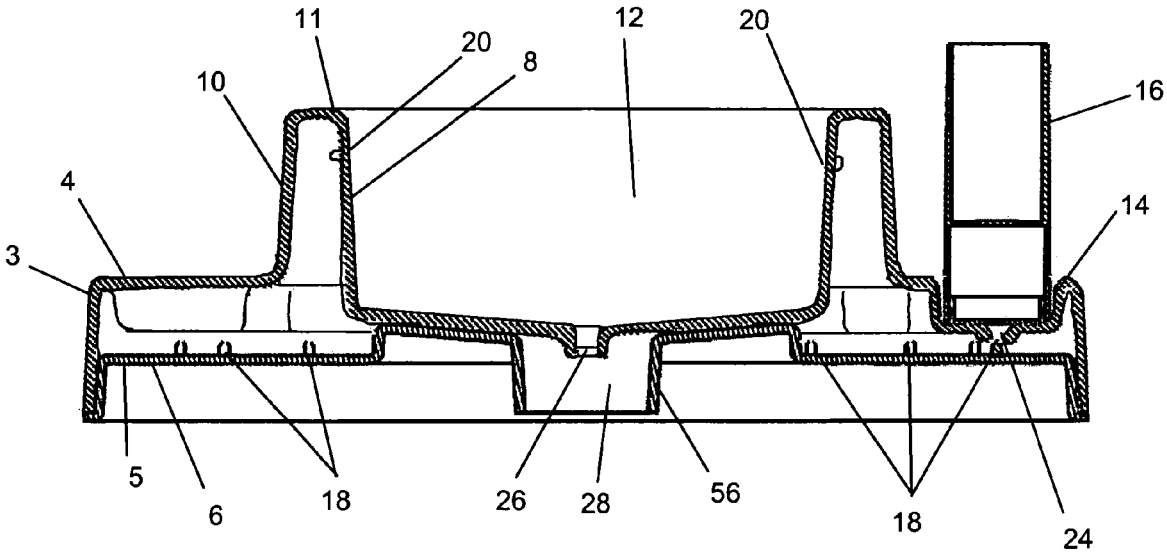
FIG. 4 is cross section A-A of FIG. 1.

FIG. 4 is sectional view along reference lines A-A of FIG. 1. FIG. 4 shows that upper portion 3 and lower portion 5 of tray body 2 are separate components that are joined together. FIG. 4 illustrates a drinking vessel 16, in this case a Dry Ice Drinking Vessel, in place in a drinking vessel receptacle 14. Drinking vessel receptacle 14 holds drinking vessel 16 and prevents drinking vessel 16 from spilling during normal handling of the tray by the server. Drinking vessel receptacle 14 may include a resilient foam spacer to more securely grip drinking vessel 16.

A drinking vessel aperture 24 is located in the drinking vessel receptacle 14 below drinking vessel 16. Drinking vessel lamps 18 are configured to direct light through the drinking vessel aperture 24 into the drinking vessel 16. Alternatively, drinking vessel receptacle 14 may be composed of a transparent or translucent material, and drinking vessel lamps 18 configured to direct light through the transparent or translucent material, eliminating the need for drinking vessel aperture 24.

FIG. 4 also shows inner wall 8 and outer wall 10 defining fill opening 11 and reservoir 12 and show reservoir lamps 20 selectably illuminating the beverage in the reservoir 12. The vacuum-formed plastic tray top side 4 may be molded of resins having any desired color. To obtain the desired visual effect, a tray upper portion 3 that is white, translucent or transparent has proved most successful.

The mechanism for filling of drinking vessels 16 from the reservoir 12 is illustrated by FIGS. 1, 4, 5, 6 and 7. As shown by FIG. 4, a reservoir aperture appears in reservoir 12 and communicates through tray top side 4. Bottom side 6 defines a dispensing opening 28. Within the reservoir aperture 26 is a metered valve assembly 30, shown by FIGS. 6 and 7 and omitted from FIG. 4. Metered valve assembly 30 preferably dispenses a predetermined amount of beverage when valve is depressed, as is well known in the art.

Figure 6:
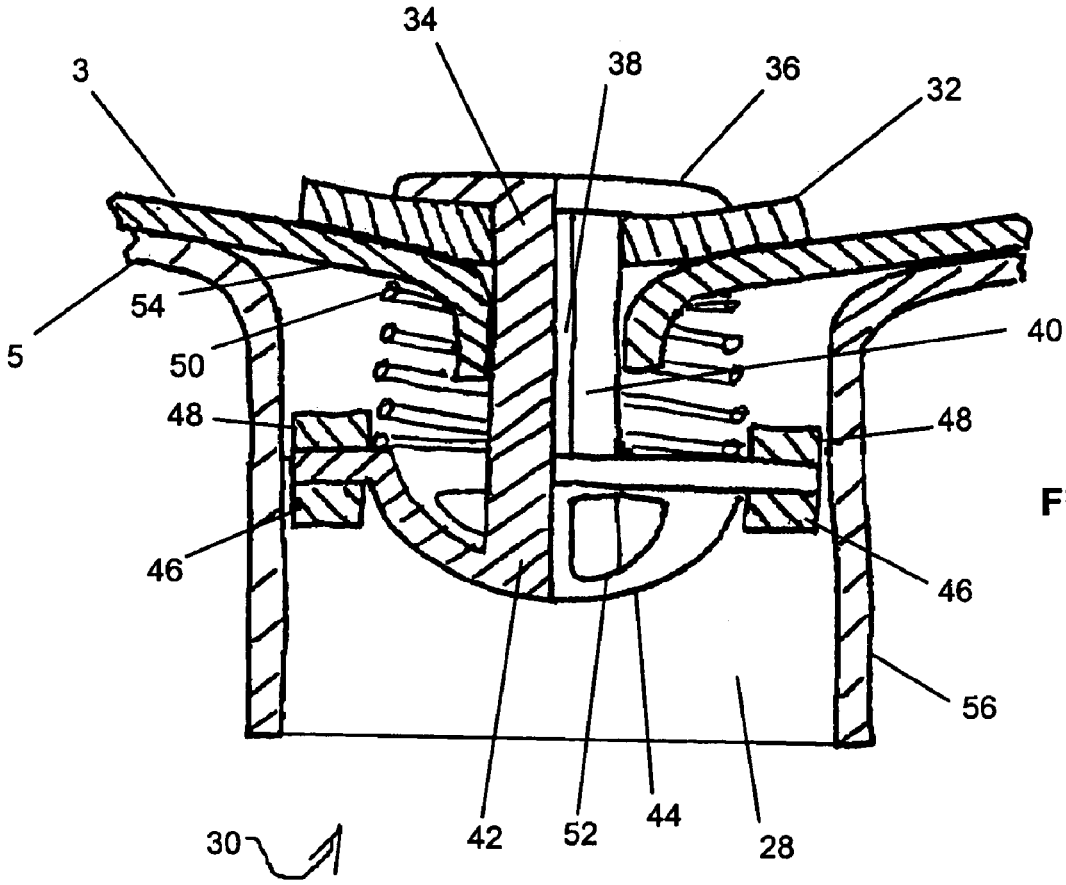
FIG. 6 is a detail cross section B-B from FIG. 5.
Figure 5:
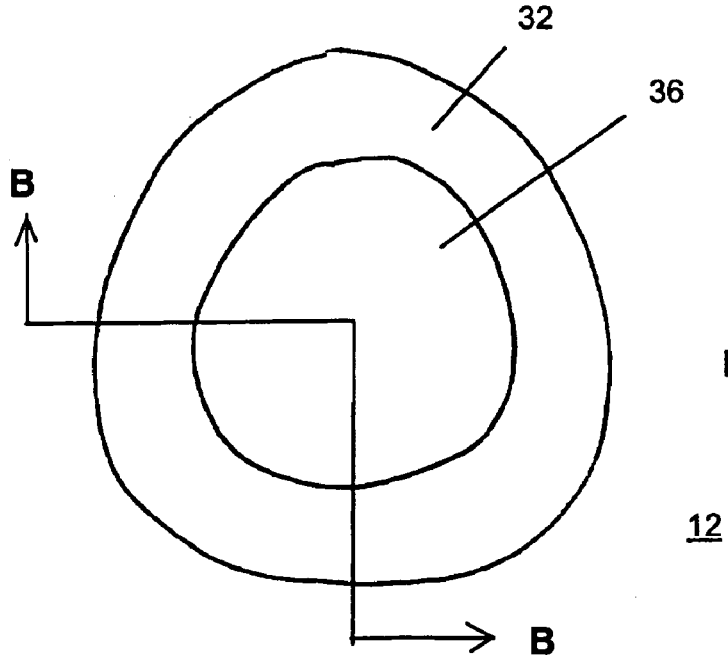
FIG. 5 is a top view of the valve assembly in place in the reservoir.

As shown by FIGS. 1, 5, 6 and 7, gasket 32 selectably seals reservoir aperture 26. Gasket 32 is operated by valve actuator 34. FIG. 5 is a top view of gasket 32 and valve actuator 34. FIG. 6 is a partial cross section of the valve actuator 34 through the reference lines B-B of FIG. 5. Valve actuator 34 has a top portion 36 that selectably presses upon gasket 32, selectably sealing reservoir aperture 26 and selectably preventing the escape of beverage from reservoir 12. Shank portion 38 of valve actuator 34 passes through reservoir aperture 26. Flutes 40 appear on shank portion 38 where shank portion 38 passes through reservoir aperture 26

A lower portion 42 of valve actuator defines a funnel 44. Lower portion 42 of valve actuator 34 supports a first seal 46 and a second seal 48. Valve spring 50 presses upon tray top side 4 and urges valve actuator 34 to the closed position, shown by FIG. 6. When the metered valve assembly 30 is in the closed position shown by FIG. 6, gasket 32 substantially prevents the escape of beverage through reservoir aperture 26.

Figure 7:
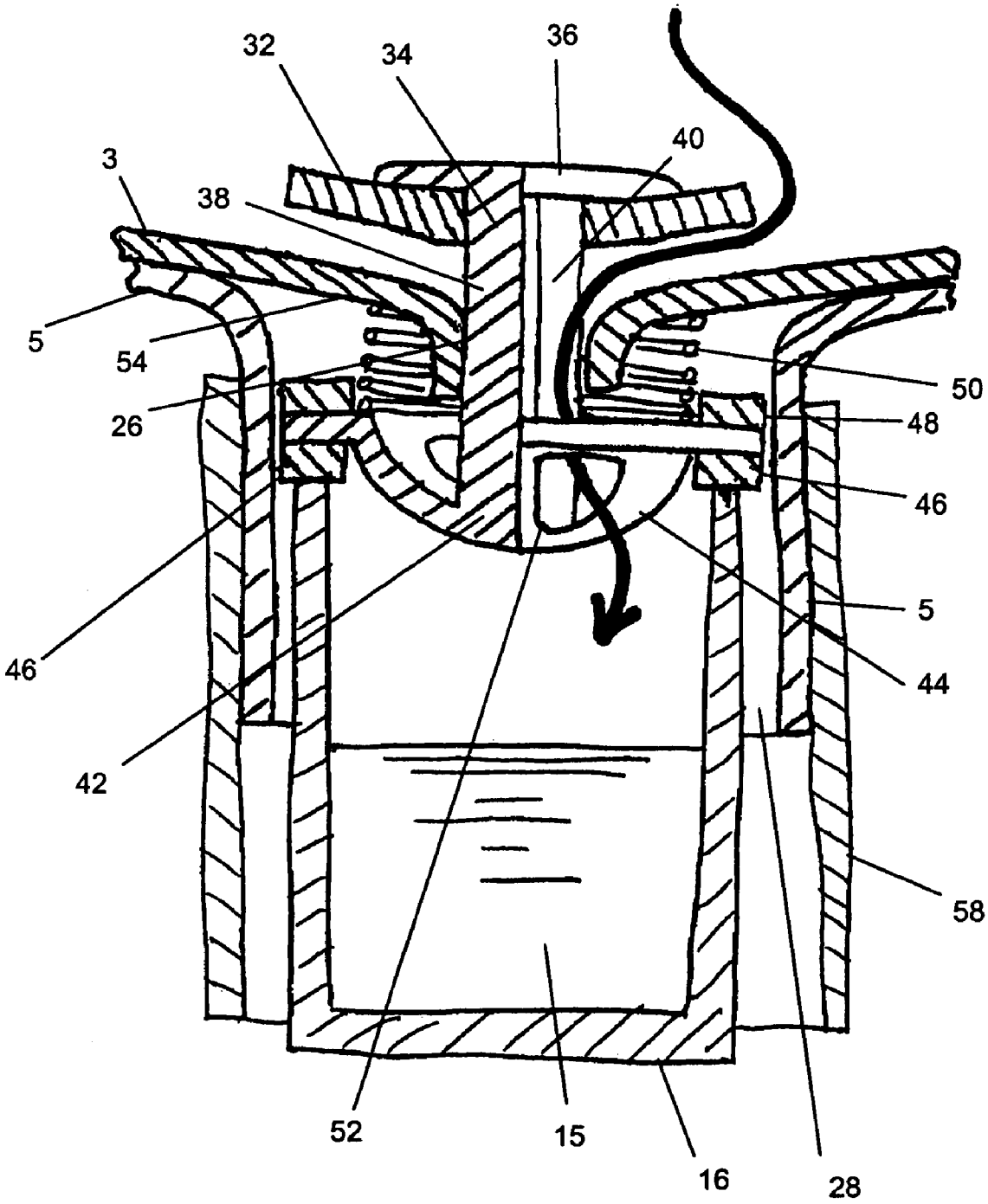
FIG. 7 is a detail cross section B-B of the valve in the open position.

FIG. 7 illustrates the metered valve assembly 30 in the open position. The server places a drinking vessel 16 within the dispensing opening 28 defined by tray bottom side 6. The server presses the drinking vessel 16 against first seal 46, substantially sealing drinking vessel 16 from splash leakage while the drinking vessel 16 is being filled. The server continues to press drinking vessel 16 against first seal 46, thereby depressing valve spring 50 and moving valve actuator 34 from the closed position illustrated by FIG. 6 to the open position shown by FIG. 7. A predetermined amount of beverage then flows from reservoir 12 through the reservoir aperture 26 around flutes 40 defined by shank portion 38 of valve actuator 34. Beverage flows to funnel 44 defined by lower portion 42 of valve actuator 34 and through funnel openings 52 into drinking vessel 16, filling drinking vessel 16. Flow of the beverage is illustrated by the heavy line on FIG. 7.

First seal 46 and second seal 48 substantially prevent beverage from escaping around dispensing opening 28 when the valve assembly 30 is in the open position. The tray body 2 may be configured so that second seal 48 engages the lower side 54 of tray top side 4 when the metered valve assembly 30 is in the open position, preventing escape of beverage.

When the predetermined amount of beverage has flowed into drinking vessel 16, server removes the drinking vessel 16 from the first seal 46. Valve spring 50 urges valve actuator 34 to the closed position shown by FIG. 6, preventing further flow of beverage through reservoir aperture 26.

Server may grip the tray body 2 by the bottom side 6 defining the dispensing opening 28. Optionally, dispensing opening 28 may be extended to form handle 58 for ease of operation by the server. FIG. 7 shows handle 58 extending tray bottom wall 56.

Figure 8:
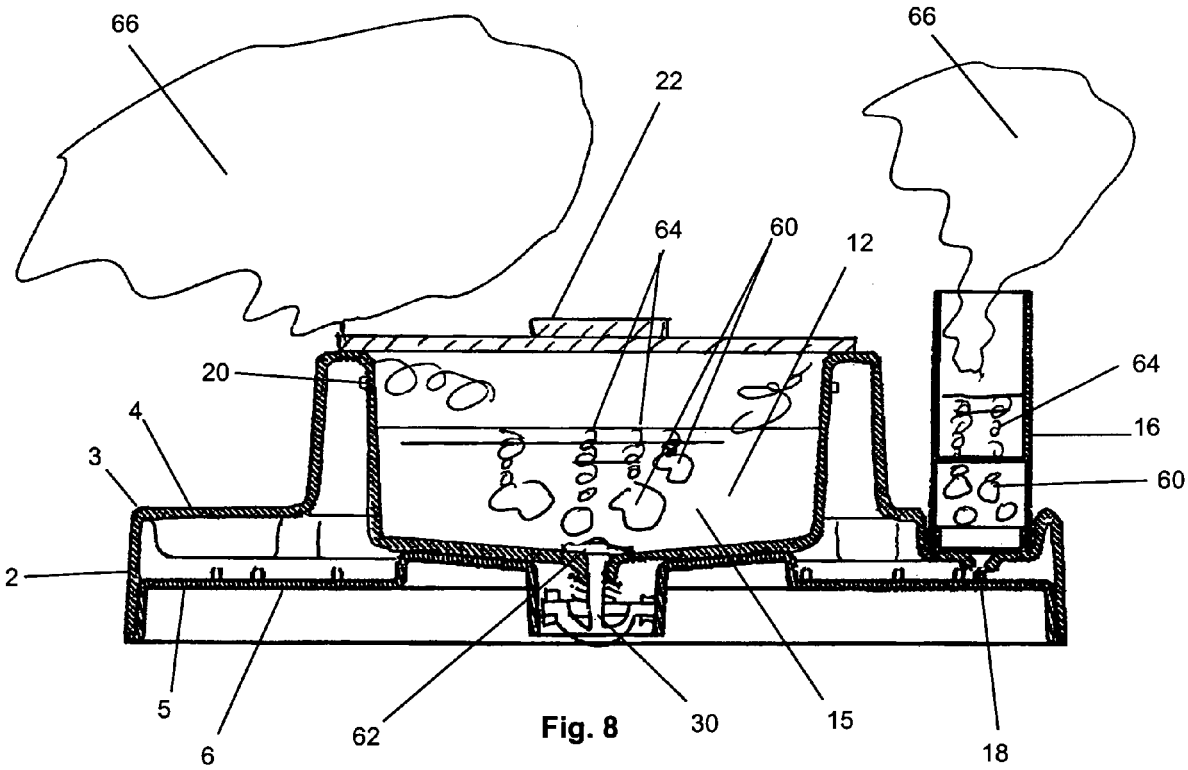
FIG. 8 is a section view of the tray in use.

As shown by FIG. 8, the tray body 2 may be used to create a smoking, boiling visual effect by placing dry ice 60 within the reservoir 12. In such event, a screen 62 may be placed across the reservoir aperture 26 to prevent entry of dry ice 60 into drinking vessel 16. The smoking, boiling visual effect is heightened by illuminating reservoir 12 with reservoir LEDs 20. The tray body 2 may be used with Dry Ice Drinking Vessels. Dry Ice Drinking Vessels benefit from the beverage being added to the dry ice 60 in the Dry Ice Drinking Vessel 16 at the last moment before serving to allow the boiling, smoking visual effect from the drinking vessel 16 to continue for the longest possible time. The tray body 2 of the Invention accomplishes this goal by allowing the server to add the beverage to the Dry Ice Drinking Vessel 16 immediately prior to serving the beverage to a patron. The boiling visual effect is created by bubbles 64 of carbon dioxide resulting from the sublimation of the dry ice 60 by absorption of heat from the beverage. The smoking visual effect 66 results from condensation of water vapor.

The use of dry ice 60 also serves to chill the beverage, both in reservoir 12 and in Dry Ice Drinking Vessel 16.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

I claim:

1. A tray, the tray comprising:

a. a tray body;

b. a reservoir defined by said tray body, said reservoir defining an interior volume, said interior volume being configured to contain a beverage;

c. a plurality of drinking vessel receptacles defined by said tray body, each of said plurality of drinking vessel receptacles being configured to engage and to support a drinking vessel;

d. a reservoir aperture, said tray body having a bottom side, said interior volume of said reservoir being in fluid communication with said bottom side of said tray body through said reservoir aperture;

e. a metered valve, said metered valve being operably connected to said reservoir aperture, said metered valve being configured to selectably allow a predetermined amount of said beverage to flow through said reservoir aperture from said interior volume of said reservoir.

2. The tray of claim 1 wherein said bottom side of said tray defines a dispensing opening, said dispensing opening being configured to engage a drinking vessel and to align said drinking vessel with said reservoir aperture, said metered valve being configured to allow said predetermined amount of said beverage to flow through said reservoir aperture from said reservoir into said drinking vessel when said drinking vessel is placed in engagement with said dispensing opening.

3. The tray of claim 2, further comprising: a vertically disposed handle, said handle depending from said bottom side of said tray body, said handle and said bottom side of said tray body being configured so that a server may grip said handle and support said tray body using a first hand of said server and simultaneously may grip said drinking vessel and bring said drinking vessel in engagement with said dispensing opening using a second hand of said server.

4. The tray of claim 3 wherein said handle defines said dispensing opening.

5. The tray of claim 3, further comprising: a lid, said reservoir defining a fill opening, said lid being configured to selectably cover said fill opening, said reservoir being configured to receive a dry ice, said engagement of said lid and said fill opening being configured to allow escape of a carbon dioxide gas and a water vapor from said reservoir, whereby said carbon dioxide gas and said water vapor may result from an exposure of said beverage to said dry ice in said reservoir when said dry ice and said beverage are placed in said reservoir and said carbon dioxide gas and said water vapor may escape from said reservoir past said lid.

6. The tray of claim 2, further comprising:

a. a lamp, said lamp being attached to said tray body;

b. a power supply operably connected to said lamp, said power supply selectably providing power to said lamp, whereby said lamp may be selectably illuminated.

7. The tray of claim 6 wherein said lamp is located proximal to said reservoir and a light from said lamp being directed toward said reservoir when said lamp is illuminated.

8. The tray of claim 6 wherein said lamp is located within one of said plurality of drinking vessel receptacles defined by said tray body and light from said lamp being directed toward said drinking vessel when said lamp is illuminated.

9. The tray of claim 8 wherein said lamp is configured to selectably illuminate a water vapor emanating from said drinking vessel when said drinking vessel is in engagement with said receptacle, said configuration of said lamp to illuminate said water vapor comprising said lamp being beneath said drinking vessel when said drinking vessel is in engagement with said receptacle, a light from said lamp being directed upward to said drinking vessel when said drinking vessel is in engagement with said receptacle.

10. A tray, the tray comprising:

a. a tray body, said tray body adapted to be supported by a one hand of a server;

b. a reservoir defined by said tray body;

c. a plurality of drinking vessel receptacles defined by said tray body, each of said plurality of drinking vessel receptacles being configured to support a drinking vessel;

d. a reservoir aperture, said tray body having a bottom side, said reservoir aperture being in fluid communication between said beverage reservoir and said bottom side of said tray body;

e. a dispensing opening defined by said bottom side of said tray body, said dispensing opening being adapted to engage said drinking vessel and to align said drinking vessel with said reservoir aperture;

f. means for dispensing a predetermined amount of said beverage into said drinking vessel from said beverage reservoir through said reservoir aperture when said drinking vessel is aligned with said dispensing opening;

g. a power supply supported by said tray body;

h. a lamp supported by said tray body, said lamp operably and selectably connected to said power supply.

11. The tray of claim 10, further comprising: an upper portion and a lower portion, said upper portion and said lower portion being joined one to the other to form said tray body, said upper portion defining said reservoir, said reservoir aperture and said plurality of drinking vessel receptacles, said lower portion defining said dispensing opening.

12. The tray of claim 11 wherein said adaptation of said tray body to be supported by said one hand of said server comprises a handle, said dispensing opening defining said handle.

13. A tray, the tray comprising:

a. a tray body, said tray body having an upper portion and a lower portion, said upper and said lower portions of said tray body being joined one to the other to form said tray body, said tray body having a top side and a bottom side;

b. a reservoir defined by said upper portion of said tray body, said reservoir defining an interior volume, said interior volume being adapted to contain a beverage;

c. a plurality of drinking vessel receptacles defined by said upper portion of said tray body and appearing on said top side of said tray body, each of said plurality of drinking vessel receptacles being configured to engage and to support a drinking vessel;

d. a reservoir aperture, said reservoir aperture being defined by said upper portion of said tray body, said interior volume of said reservoir and said bottom side of said tray body being in fluid communication through said reservoir aperture;

e. a valve, said valve being operably connected to said reservoir aperture, said valve being adapted to selectably dispense said beverage through said reservoir aperture;

f. a dispensing opening defined by said lower portion of said tray body, said dispensing opening being configured to engage said drinking vessel and to align said drinking vessel with said reservoir aperture, said dispensing opening and said valve being adapted so that engagement between said dispensing opening and said drinking vessel actuates said valve, thereby dispensing said beverage into said drinking vessel.

14. The tray of claim 13, further comprising:

a. a power supply supported by said tray body;

b. a lamp supported by said tray body, said lamp operably and selectably connected to said power supply.

15. The tray of claim 14 wherein lamp is located between said upper and said lower portions, said lamp being adapted to selectably illuminate said beverage when said beverage is located within said interior volume.

16. The tray of claim 15 wherein said valve is a metered valve, said metered valve being adapted to dispense a predetermined amount of said beverage from said reservoir through said reservoir aperture to said drinking vessel when said metered valve is actuated.

17. The tray of claim 16, further comprising: a handle; said handle defining said dispensing opening, said tray body and said handle being adapted so that a server may support said tray body with a one of said server's hands.

* * * * *